United States Patent [19]

Grubman

[11] 4,225,047

[45] Sep. 30, 1980

[54] MAGNETIC CAN SEPARATOR

[75] Inventor: Alan A. Grubman, Chicago, Ill.

[73] Assignee: The Continental Group, Inc., New York, N.Y.

[21] Appl. No.: 43,952

[22] Filed: May 30, 1979

[51] Int. Cl.[3] ..... B07C 5/02; B07C 5/344

[52] U.S. Cl. ..... 209/544; 209/636

[58] Field of Search ..... 209/636, 215, 219, 540, 209/544, 662

[56] References Cited

U.S. PATENT DOCUMENTS

| | | | |
|---|---|---|---|
| 2,748,940 | 6/1956 | Roth | 209/219 |
| 2,900,076 | 8/1959 | Israelson et al. | 209/215 |
| 3,057,477 | 10/1962 | Rappaport | 209/215 X |
| 3,327,852 | 6/1967 | Mortsell | 209/219 |
| 3,749,240 | 7/1973 | Spears | 209/636 X |
| 4,084,496 | 4/1978 | Ehernberger et al. | 209/215 |

*Primary Examiner*—Allen N. Knowles

*Attorney, Agent, or Firm*—Charles E. Brown

[57] ABSTRACT

A magnetic can separator which is specifically constructed for assuring the separation of all-aluminum cans from steel and steel-aluminum cans. The separator includes a magnetic drum onto which cans to be classified are directed and there is a deflector plate spaced from the path of the drum a distance such that a can must be disposed parallel to the axis of the drum before it can pass the deflector plate, thereby assuring that any steel component of a can will be attracted to the drum and will be delivered to a receiving area in exclusion of a receiving area for all-aluminum cans.

9 Claims, 1 Drawing Figure

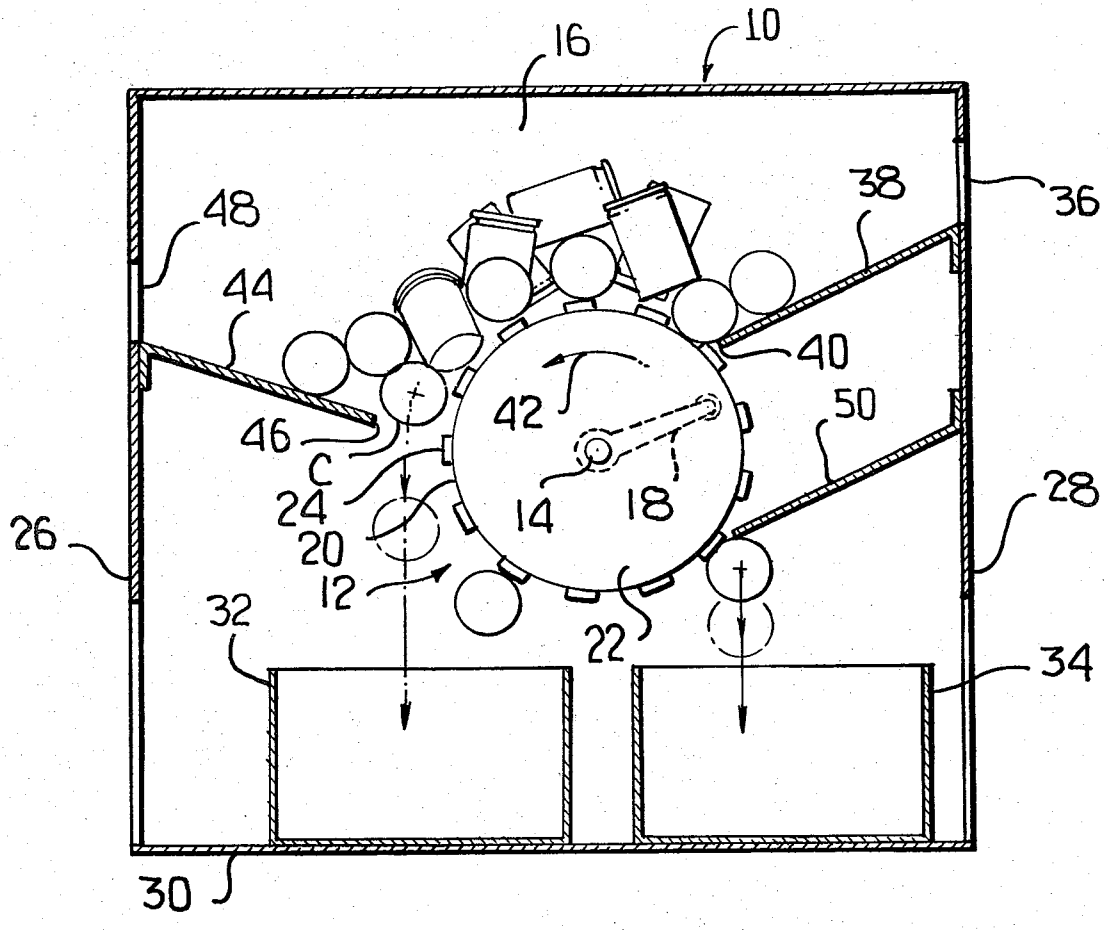
10
16
36
38
40
50
28
34
18
22
42
14
12
20
24
C
46
44
48
26
32
30

MAGNETIC CAN SEPARATOR

This invention relates in general to new and useful improvements in magnetic separators, and more specifically to a magnetic separator for separating all-aluminum cans from steel cans and combination steel and aluminum cans.

All-aluminum cans are substantially more valuable as scrap or for recycling than steel cans or steel and aluminum cans. Accordingly, it is the primary function of this invention to provide a magnetic separator which assures the separation of all-aluminum cans from cans which may have aluminum components only, such as end units.

Most particularly, it is to be understood that there are commercially available at this time three types of cans, particularly in the beer and beverage field. These cans include steel cans having steel ends. There are also aluminum cans having aluminum ends. Finally, there are steel cans having at least one aluminum end. It will be readily apparent that when a magnetic separator is exposed to the all-steel-cans, the all-steel cans will be assuredly attracted by the magnetic means of the separator and be separated from all-aluminum cans. However, when a combination steel and aluminum can is processed, and which aluminum component is positioned adjacent the magnetic component of the separator, in many instances the combination steel and aluminum can will be recognized by the magnetic separator as an aluminum can and thus will be deposited in the receptacle for all-aluminum cans. Thus the purity of all-aluminum is not maintained.

This invention particularly relates to a construction of a magnetic can separator wherein separation of all-aluminum cans from all-steel and part aluminum, part steel cans is assured.

The invention specifically relates to the provision of a deflector in association with a magnetic drum with the deflector being so positioned relative to the drum so as to orient cans which are being classified so that they lie parallel to the axis of the drum and therefore the cylindrical body of the can is always presented to the magnetic means of the drum. In this manner the all-steel and part-steel cans are positively attracted to the magnetic means and rotate with the drum while the all-aluminum cans fall free of the drum into a special hopper for receiving the same.

With the above and other objects in view that will hereinafter appear, the nature of the invention will be more clearly understood by reference to the following detailed description, the appended claims, and the accompanying drawing.

The drawing is a schematic sectional view of the magnetic can separator taken generally along a vertical plane normal to the axis of rotation of the drum.

Referring now to the drawing in detail, it will be seen that in the simplest terms the magnetic can separator of this invention includes a suitable housing 10 in which there is mounted for rotation a separator drum generally identified by the numeral 12. The separator drum 12 has a substantially horizontally disposed shaft 14 which is suitably journalled in a manner not shown at opposite end walls 16 of the housing 10. Although the drum 12 may be motorized, for purposes of simplicity the drum is illustrated as being provided with a handle or crank 18 which will be disposed externally of the housing 10.

The drum 12 is simply illustrated as including a cylindrical drum element 20 having opposite circular ends 22 suitably secured to the shaft 14. The drum element 20 has secured to the periphery thereof a plurality of magnets 24 which are circumferentially spaced. The magnets 24 are preferably in the form of bars which extend parallel to the axis of the drum 12.

The housing also includes a pair of opposed side walls 26, 28 and a bottom wall 30. Suitably positioned within the housing 10 and preferably seated on the bottom wall 30 are hoppers 32 and 34 for receiving classified cans, the hopper 32 being particularly intended for receiving all-aluminum cans and the hopper 34 being intended to receive all-steel and steel-aluminum cans.

The side wall 28 is provided with a delivery opening 36 which is disposed immediately above a gravity infeed chute 38. The gravity infeed chute 38 has an inner end 40 which terminates adjacent to the path of the magnets 24 such that cans delivered to the gravity infeed chute 38 cannot pass in a clockwise direction between the end 40 and the drum 12. The magnets 24 function as lugs and serve to move the received cans in a counterclockwise direction as indicated by the arrow 42 when the drum 12 is rotated.

It is to be noted that the cans to be classified, when delivered into the housing 10 through the opening 36, are directed onto the drum 12 in the upper righthand quadrant of the drum, and thus are first elevated by the drum and then are moved downwardly by the drum.

In order that all of the cans may be forced to lie parallel to the drum 12 in a position such as that shown with respect to the can C, there is carried by the side wall 26 deflector means in the form of a deflector plate 44. The deflector plate 44 has a free end 46 disposed adjacent to the path of travel of the magnets 24, but is spaced therefrom a distance slightly greater but substantially the same as the diameter of the cans C which are intended to be classified or sorted. Thus, each can C carried by the drum 12 cannot pass the deflector plate 44 unless it is rotated to a position where it lies parallel to the axis of the drum 12.

It is preferred that the deflector plate 44 be located in the upper lefthand quadrant of the drum travel as is clearly illustrated in the drawing.

Although the primary function of the deflector plate 44 is to engage each and every can carried by the drum 12 to make certain that it lies parallel to the axis of the drum, if desired the deflector plate 44 may have a second function. The side wall 26 may have an entrance opening 48 immediately above the deflector plate 44 so that it may also function as a gravity infeed chute. In such event the deflector plate 44 must extend all the way to the side wall 26 and must slope downwardly toward the drum.

It is also necessary that the end 46 of the deflector plate 44 generally overlie the central portion of the hopper 32 so that when an all-aluminum can is deflected and turned to lie parallel to the axis of the drum, and the can falls through the space between the drum and the deflector plate end 46, it will drop directly into the hopper 32.

Thus all-steel and steel-aluminum cans which are turned by the deflector plate 44 to be parallel to the axis of the drum 12 will adhere to the magnets 24 and will be carried down below the drum across the hopper 32 to a position vertically overlying the hopper 34 where they are engaged by a discharge or scraper plate 50. The discharged steel and steel-aluminum cans drop into the hopper 34.

At this time it is pointed out that although substantially all steel-aluminum cans have steel bodies and aluminum ends, by deflecting all cans so as to lie parallel to the axis of the drum 12, the cans are also made to lie parallel to the magnets 24. Thus, even though normally all steel-aluminum cans have steel bodies and aluminum ends and the bodies may be attracted by the magnets, in the rare instance where the bodies are aluminum and there is at least one steel end, the end being secured to the body by a double seam has a peripheral portion which would be attracted to the magnets 24 to the extent that such a can would also be retained by the drum 12 to be scraped therefrom by the scraper plate 50.

It will be thus apparent that even though the magnetic can separator is of an extremely simple construction, it will serve to separate all-aluminum cans without fail from steel and steel-aluminum cans so as to assure the purity of the collected aluminum cans and thus permit a high salvage.

Although only a preferred embodiment of the separator has been specifically illustrated and described herein, it is to be understood that minor variations may be made in the separator without departing from the spirit and scope of the invention as defined by the appended claims.

I claim:

1. A magnetic can separator comprising a drum having a substantially horizontal axis of rotation, said drum having a periphery and magnetic means disposed about said periphery, separate first and second receiving means disposed below said drum for receiving in sequence in the direction of drum rotation non-magnetically attractive cans and magnetically attractive cans, discharge means overlying said second receiving means for removing cans magnetically adhering to said drum, and deflector means for deflecting each can placed in said separator to a position substantially parallel with said drum axis prior to movement of the can to a position for discharging into one of said receiving means.

2. The can separator of claim 1 wherein said deflector means lies at a position at least at the height of said drum axis.

3. The can separator of claim 1 wherein said deflector means lies at a position at least at the height of said drum axis and overlying said first receiving means.

4. The can separator of claim 1 wherein said deflector means is in the form of a gravity infeed chute having a terminal end disposed in spaced relation to said drum periphery a distance generally equal to but slightly greater than the intended can diameter.

5. The can separator of claim 1 wherein said discharge means lies at a position generally below the height of said drum axis.

6. The can separator of claim 1 wherein there is a separate gravity infeed chute.

7. The can separator of claim 6 wherein said separate gravity infeed chute is located on a side of a vertical plane through said drum axis remote from said deflector means.

8. The can separator of claim 6 wherein said deflector means lies at a position at least at the height of said drum axis.

9. The can separator of claim 7 wherein said deflector means lies at a position at least at the height of said drum axis and overlying said first receiving means.

* * * * *